United States Patent [19]

Johnson

[11] Patent Number: 4,813,473

[45] Date of Patent: Mar. 21, 1989

[54] HEAT REGENERATOR TO RECOVER BOTH SENSIBLE AND HEAT CONDENSATION OF FLUE GASES

[76] Inventor: Arthur F. Johnson, 240 Fox Dr., Boulder, Colo. 80303

[21] Appl. No.: 174,085

[22] Filed: Mar. 28, 1988

Related U.S. Application Data

[62] Division of Ser. No. 96,183, Sep. 11, 1987, which is a division of Ser. No. 885,902, Jul. 15, 1986, Pat. No. 4,703,794.

[51] Int. Cl.[4] ..... F28D 19/04

[52] U.S. Cl. ..... 165/7; 165/8; 165/9.2; 165/10; 122/421; 122/DIG. 1

[58] Field of Search ..... 165/8, 1 D, 9.2, 7; 122/421

[56] References Cited

U.S. PATENT DOCUMENTS

| | | | |
|---|---|---|---|
| 1,912,784 | 6/1933 | Miller et al. . | |
| 2,548,002 | 4/1951 | Daniels | 165/9.2 |
| 2,803,439 | 8/1957 | Fikenscher | 165/7 |
| 2,913,228 | 9/1959 | Fikenscher . | |
| 3,114,413 | 12/1963 | Nyberg | 165/8 |
| 3,144,903 | 8/1964 | Stockman | 165/7 |
| 4,398,590 | 8/1983 | Leroy | 165/7 |
| 4,611,652 | 1/1986 | Bernstein et al. . | |

FOREIGN PATENT DOCUMENTS

| | | |
|---|---|---|
| 672293 | 2/1979 | France . |
| 2081866 | 8/1982 | United Kingdom . |

*Primary Examiner*—Albert W. Davis, Jr.
*Attorney, Agent, or Firm*—Pennie & Edmonds

[57] ABSTRACT

A compact and maintenance-free means and method of regenerating the sensible heat from flue gases of fossil fuel furnaces by heat exchange through two circular layers of rock beds rotating under two semi-circular mantles with the first mantle applying hot flue gases to the beds and the second withdrawing preheated ambient air needed for combustion by said furnaces. When used for power plant flue gas treatment, layers of acid-resistant pipes containing boiler feedwater are sandwiched between the two rock bed layers to usefully recover the heat units arising from moisture condensation. The enormous water of condensation collects flyash and sulphur dioxide thus removing these pollutants from the stack gases. The heavy rock beds rotate slowly beneath the fixed mantles in a circular, pan-shaped, steel vessel floating on and cooled by a circular pond of water. Friction of rotation is minimal and gas leakage principally prevented by liquid seals. When flue gas temperature rises, as above 600 degrees F, additional heat exchange capacity is increased by increasing speed of rotation, top bed of pebbles having a size around one to two inches need only be about one foot thick. This bed rests on layers of volcanic rocks five feet or more in thickness and sized each by layer downward from three to six inches in diameter to allow the cleaned and cooled flue gases to escape radially outward to the peripheral rim.

2 Claims, 5 Drawing Sheets

HEAT REGENERATOR TO RECOVER BOTH SENSIBLE AND HEAT CONDENSATION OF FLUE GASES

This is a division of application Ser. No. 096,183, filed 9-11-87, which is in turn a division of Ser. No. 885,902, filed 7-15-86, now U.S. Pat. No. 4,597,433 granted July 1, 1986.

BACKGROUND OF THE INVENTION

The rotating metal heat recuperators of prior art, such as the highly successful Ljunsgtom type, are subject to flue dust erosion and acid mist corrosion below about 300° F. Likewise their enormous fabricated metal weight and structural support are expensive and support bearings and labyrinth gas seals are complex. While the straight-through-downward path of flue gases between closely-spaced metal sheets provides self cleaning features, it does not provide the enormous heat transfer rates under turbulent flow around each particle afforded by rock beds. The enormous size of subterranean rock beds disclosed in my copending patent application, Ser. No. 639,307, filed Aug. 9, 1984, are avoided by merely rotating the beds, while the dampers to reverse direction of gas flows are eliminated.

No prior art is known which is one apparatus continuously first regenerates the sensible flue gas heat from the range of 800° F. to 250° F., second recovers the heat of condensation from 250°-110° F. and lastly regenerates the sensible heat from 250°-70° F. which is necessary to insure sulphur dioxide fumes are dissolved in the water of condensation.

OBJECTS OF THE INVENTION

It is a general object of the invention to provide improved means of pollution control for fossil-fuel-burning furnaces and the like.

A further object of the present invention is to provide improved means of recovery of both sensible and latent heat of condensation as well as byproduct recovery from flue gases in boiler plants.

A still further object is to provide improved means of heat and byproduct recovery for boiler flue gases which are an economic benefit to the operation.

Still another object of the present invention is to provide multiple, circular rotating pebble beds between which are sandwiched acid-proof boiler feedwater pipes. A first semi-circular mantle above the beds applies flue gases and a second semi-circular mantle withdraws preheated air for combustion.

Still another object of the invention is to support and rotate rockbeds in a circular, pan-shaped vessel which floats in a circular pond of water that helps cool the beds and provides gas seals preventing escape of hot flue gases passing into the beds and preheated air passing out of the beds.

In essence the present invention is based, at least in part, by the discovery that current pollution control systems largely waste sensible heat in flue gases below certain temperatures as well as waste all the enormous heat of moisture condensation. This is largely because of the corrosive nature of gas and condensate at such temperatures. Therefore vast sums are now spent chemically neutralizing the gas and condensate, when indeed a better approach is to employ acid-resistant materials so contained sulphur is never oxidized to sulphuric acid, but is rather recovered as marketable $SO_2$. The expense of neutralization is thus avoided, a marketable byproduct is produced and, most important, by utilizing previously wasted heat of condensation and sensible heat to respectively heat boiler feedwater and preheat combustion air going to the boiler, savings of truly surprising dimensions are achieved, as set forth in more detail hereinbelow.

These and other objects and advantages of the invention will become clear from the following detailed description of embodiments of same illustrated by drawings, and novel features will be particularly pointed out in connection with the appended claims.

BRIEF DESCRIPTION OF THE DRAWINGS

Reference will hereinafter be made to the accompanying drawings in which.

DESCRIPTION OF THE PREFERRED EMBODIMENTS

Figure 1:
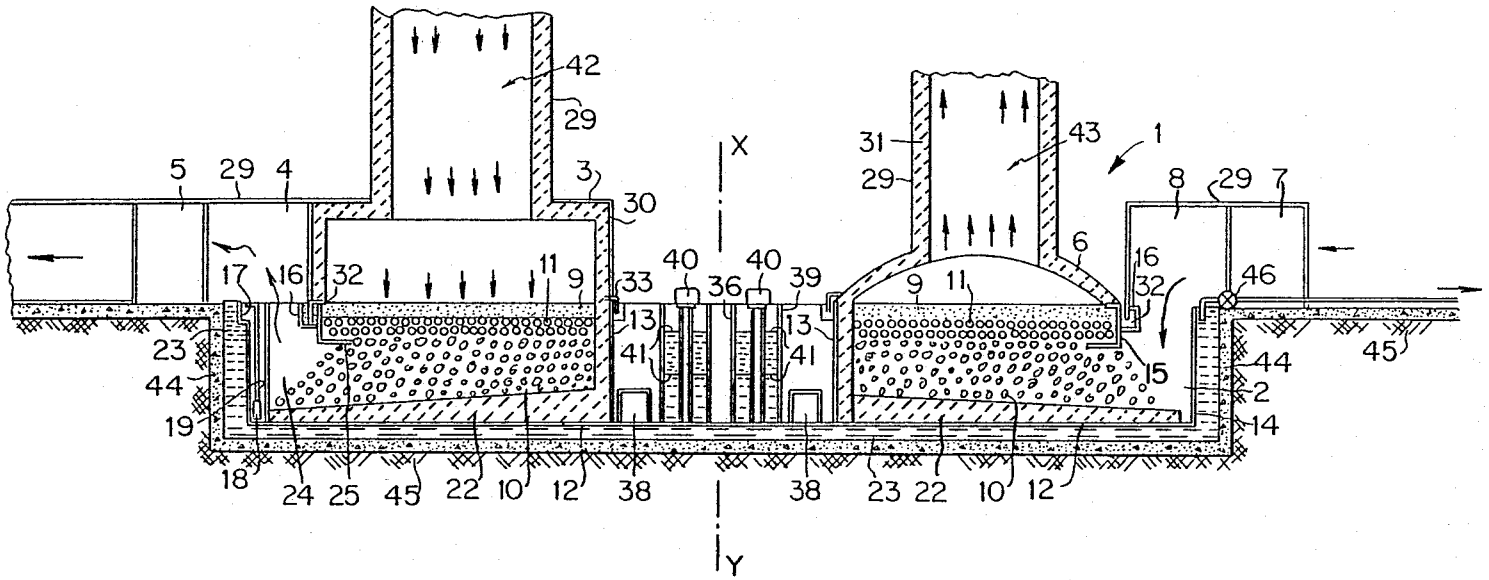
FIG. 1 is a vertical cross section through a circular rotating rock bed heat regenerator of the invention.

As shown in FIG. 1, the pan-shaped, rotating heat regenerator 1 is floating on water and consists of the steel vessel 2 containing the refractory beds for heat exchange revolving clockwise around vertical axis X-Y beneath two semicircular hoods fixed in space above them. Hot flue gas mantle 3 distributes flue gases to the upper face of the rotating refractory beds while cold mantle 4 receives the resulting downward drawn, cooled and cleaned flue gases from under the beds; and, by induced draft fan 5, directs them to the stack. Simultaneously, hot preheated air mantle 6 withdraws preheated air from the upper face of the refractory beds for delivery to the combustion furnace. This air, under pressure, is delivered to the bottom of the beds from ambient air via fan 7 and cold mantle 8. As the air rises through the bed, it cools the beds to ambient air temperature before they revolve clockwise under mantle 3 to be reheated by flue gases. The upper two layers of refractory beds 9 are only about two-feet thick and have uniformly sized pieces about one to two inches in diameter. The pieces are natural volcanic rocks or artificial stone like coal slag. Similarly carefully sized layers of volcanic boulders, ranging in size from about three to twelve inches in diameter, constitute the lower beds 10 which remain cold and present little comparative resistance to flow through them horizontally or vertically. Sandwiched between the two rock layers 9 are layers of acid-resistant metal pipes 11 which carry boiler feedwater moving at a speed of perhaps ten feet per second. The water has a bed entering temperature of about 107° F. and cools the flue gases to condensation and absorbs the heat of condensation, as distinguished from sensible heat of gases. This heats the feed water to perhaps 200° to 220° F., thus saving steam currently conventionally used to heat feedwater which leaves the boilerhouse condensors at around 107° F. Since the number of BTU's of heat saved in the heat of condensation may equal or exceed those saved in regenerating the sensible heat of flue gases, this is a major discovery of this invention. The feedwater pipes are individually surrounded by pebbles which cause the heat exchange to be under turbulent flow so as to create a higher heat exchange rate per unit surface area of pipe than without turbulent flow. The thick bed of larger rocks beneath of feedwater pipes are necessary to cool the flue gases from perhaps 120° F. to ambient air, such as 70° F.; thereby capturing more sensible heat, and condensing the $SO_2$ fume to dissolve it in the condensate which is driven downwardly and outwardly to the shell bottom periphery.

The circular bottom 12 of the pan-shaped vessel containing the beds is ½ inch thick or thicker steel plate inner surfaced with stainless steel as is also the central circular pan made of at least half-inch thick lined steel plates enclosed by wall 13 and ring-shaped perimeter 14 both welded to flat bottom 12. The outer ring 15 must also be lined with acid-resistant steel as it holds the bed in place laterally and is exposed to weak sulphurous acid in the condensate when the flue gases move downwardly and radially outward. The circular gas-seal gutter 16 welded to 15 can be pH controlled and so is not subject to corrosion. However, the gutter 17 receives condensate and fly ash from the pumps 18 so must be made of stainless steel along with the pumps and pump sump 19 which keep this gutter drained by pumping with pump 96 the condensate to flyash separating equipment and thence to vacuum extraction of the $SO_2$ after which it may be used to flush the beds via spray pipe complex 20 on gas seal plate I of FIG. 2. When necessary, massive amounts of water may alternatively be used to flush beds.

The inside bottom of the pan-shaped vessel is made to slope outwardly towards the perimeter to deliver, by gravity and by flue gas velocity, the acidic condensate thereto where the pumps 18 within pump sump 19 can pick it up together with fly ash suspended in condensate. A little ambient air gas leakage allowed into stack gas in this peripheral pump channel blows the condensate flowing in the same direction as bed rotation. The acid resistant layer 22 on the bottom 12 may be made of densely graded acid resistant material, such as silica sand and quartz aggregate mixed with tar and pitch and rammed against the lead oxide painted steel shell since the bottom plate is kept cold by the water 23 on which it floats and rotates in a circular pond surrounded by concrete 44 supported upon earth 45. A pipe system 46 allows water 23 to be added or reduced or cooled as required. A layer of temperature and acid-resistant refractory material 22 protects heat escape from the beds toward the central core. The space 24 between 14 and 15 is the space around the periphery of the vessel through which ambient air is forced by fan 7 into the bottom of the beds in the air preheating semi-cycle and is the space where cooled and cleaned flue gases are drawn by induced draft fan 4 in the opposite semi-cycle. An inward projecting horizontal stainless steel ring 25 serves the purpose of keeping space 24 more open for gas exit and prevents downward short circuit of gas from the upper bed which is composed of slightly smaller pebbles near the bed periphery than near the central axis X-Y for the same purpose of making the various gas paths of equal resistance and flow per surface unit of cross-section uniform.

Figure 2:
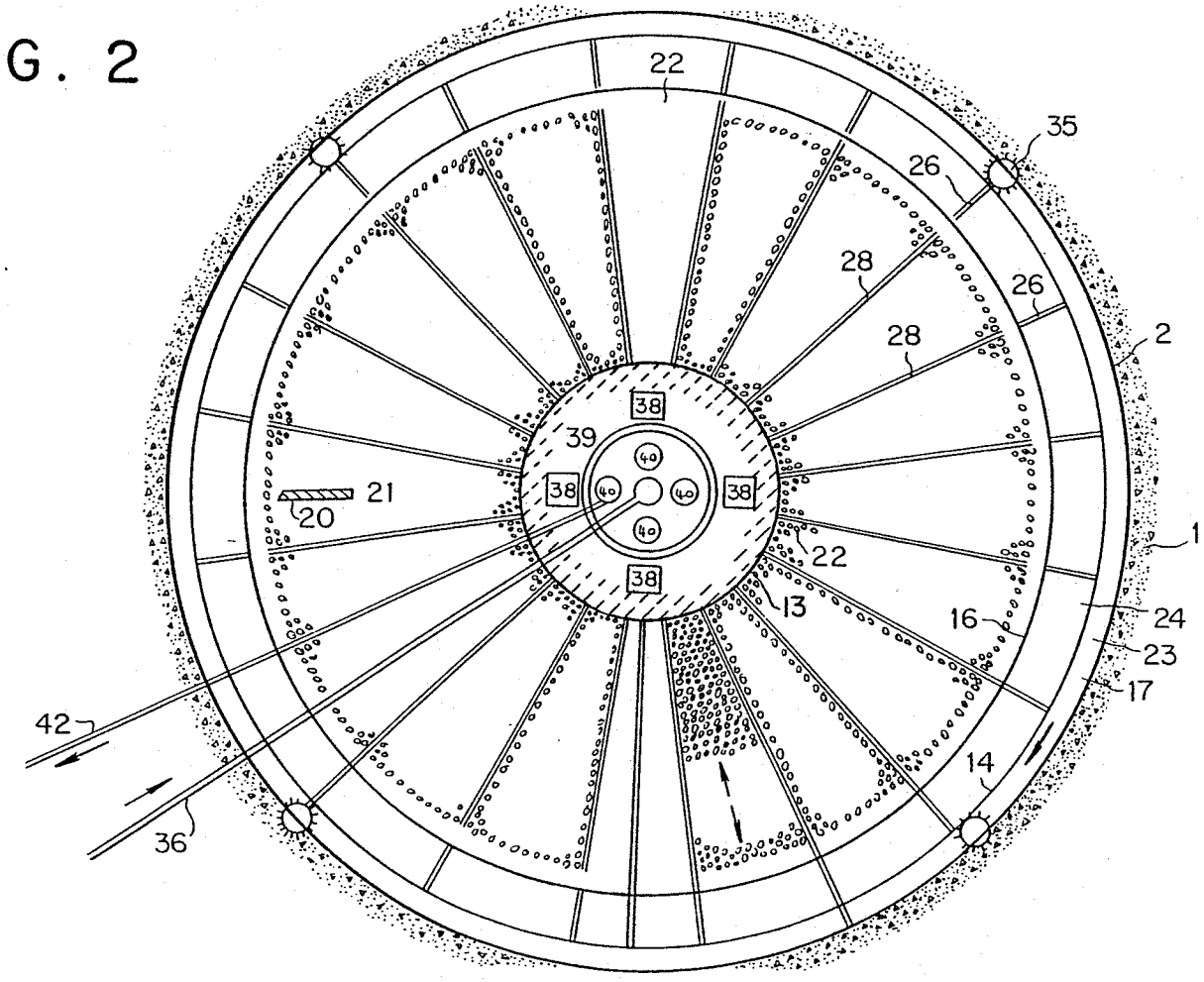
FIG. 2 is a plan view of the rock bed of FIG. 1 with the mantles removed.

There are twenty stainless steel vertical vanes 26 as shown in FIG. 2. Vanes 26 extend top to bottom of space 24 structurally joining 14 to 15, thus supporting the latter as well as gutter 27 and ring 25. Similarly, twenty stainless steel vertical vanes 28 extend top to bottom of both fine and coarse pebble beds to segment these and prevent circular horizontal flow from the area under mantle 6 which is under slight "gauge pressure", to the area under mantle 3, which is under slight vacuum compared to ambient air. The gas steal plates 21 and 22 of FIG. 2 separating hot mantles 3 and 6 by one segment insure against such gas leakage of being of any consequence. The mantle exteriors are all made of steel plate 29, and in the case of hot mantle 3 handling flue gases, lined with an acid proof, suspended refractory 30. In the case of hot mantle 6, the refractory 31 may be a poured-in-place refractory with an arched roof during construction which is a cheap method of fabrication. The inner and outer semicircular rings of both mantles 3 and 6 have extended tips 32 and 33 to make water seals with the water respectively in outer gutter 16 or inward gutter 34.

A power drive for rotation is provided as shown in FIG. 2. There are at least four peripheral locations 35 where a speed reducer pinion gear contacts a pin rack on the outside diameter of 14 to both drive and keep centered on verticle axis X-Y the vessel 2 accurately enough so the water seals will not be damaged. The entire regenerator is easily raised or lowered to maintain a fraction of an inch clearance between beds or the mantles and seal plates by respectively adding to or taking from the height of the water 23 supporting the vessel. This water is maintained cold with additions of the coldest water available to keep bottom and sides cool and so cool and condense $SO_2$ from the air exhausting from space 24.

A principle object of this invention is to absorb the heat of condensation of flue gases in the feedwater to the boiler from whence the flue gases arise. This is accomplished as follows:

As shown in FIG. 1 the pipes 11, which may be stainless steel or preferably titanium, are about one-inch diameter and arranged in several circles one above the other and all within the second one-foot thick layer of the beds to constitute a number of circuits in parallel from headers with appropriate automatic valves so if one circuit leaks and loses pressure, it is automatically disconnected. The lowest pipe layers receive about 170° F. water and feed the next layer above so the top layer with feedwater at about 212° F. is closest to the flue gases entering the top of the beds a foot or more above the these uppermost pipes. The pipe 36 of FIG. 2, bringing steam condensate from the boiler house at a temperature of perhaps 107° F., empties into innermost tank 39 which rotates and is supported on the vessel bottom 12. Pipes from 36 connect with all four feedwater pumps 38 which pump into the lowest layer of pipes 11 at a speed of as much as 10 feet per second. The 212° F. water from the uppermost layers of pipe 11 circuits feed into surge tank 39 which also rests upon and rotates with vessel bottom 12. The four "deep well" pumps 40 are suspended from the plant superstructure and do not rotate with tank 39. They are easily removable for repair and pass through holes in one or more annular rings 41 of FIG. 1 which are suspended beneath or float upon the water to keep the 212° F. water which comes into the bottom of tank 39, from rising to the surface and evaporating therefrom. The approximately 212° F.

water from pumps 40 passes via pipe 42 to the boiler feedwater system where it is heated conventionally by steam to higher temperature before entering the pipes within the boiler itself. A multiplicity of pumps and pipe circuits eliminate forced downtime of the rotating rock beds for repair and maintenance. The central pan 13 is shown about 40 feet in diameter with ample space for these pumps and headers. Easy access is made possible via gas seal plates 21 and 22 which are attached to the mantles and supported from plant superstructure. In FIG. 1 the duct 42 supplies flue gas to hot mantle 3 while the duct 43 carries preheated flue gas from hot mantle 6 to the boiler furnace for combustion to the flue gases which issue from 42. Each duct is lined with refractories appropriate for the gases which they carry.

The invention may be simplified in construction and operation by not rotating the beds but by embedding pipes at each level above and below the level where boiler feedwater pipes are embedded. In each of these levels above and below a pump is used connecting to the encircling "pancake" of pipe to rapidly circulate water therethrough thus keeping each level so equipped at about the same temperature throughout so the sensible heat of the flue gases is transferred to the air being preheated for combustion. The key to the performance of this is the discovery of the high heat transfer rate to and from pipes when the gas passing around them is under the turbulent conditions which pebbles induce. The limit of this design is principally the high cost of tubes which are preferably titanium which last indefinitely under the corrosive action where even stainless steel fails over a period of years. Those choosing to utilize this invention may find herein sufficient data to evaluate the return on the investment on the various alternates provided herein. Obviously such fixed beds may be suitable for flue gases from furnaces burning oil or gas but not for coal-fired boilers, because they cannot be flushed down regularly with fresh water or with condensate water from which the sulphur dioxide has been extracted as is possible with each rotation in the case of the rotating beds of this invention.

By a study of the following examples, those interested in utilizing this invention will be able to estimate the heat recovery possible with various fossil fuels and estimate the cost of the apparatus needed for this purpose.

It should be noted that the artificial or natural rockbeds of this invention have on the order of one-tenth the coefficient of expansion of conventional Ljunstrom metal heat regenerators, so have less expansion and contraction problems.

The stack gases of this invention consist principally of nitrogen, carbon dioxide and smaller amounts of oxygen and carbon monoxide, so harmlessly diffuse in the air at stack outlet eliminating existing pollution dangers and at a profit to the power plant heretofore not achievable.

EXAMPLE I

A specific example which will aid in understanding the invention is set forth hereinbelow:

| Coal Analysis Ultimate Pct | Coal Analysis Including Moisture | | Lbs. of Each Ingredient/Lb. Of Coal Fired |
|---|---|---|---|
| Carbon | 48.31 | 34.21 | 0.3421 |
| Hydrogen | 6.53 | 4.62 | 0.0462 |
| Nitrogen | 0.67 | 0.47 | 0.0047 |
| Oxygen | 39.02 | 27.63 | 0.2763 |

-continued

| | | | |
|---|---|---|---|
| Sulphur | 0.35 | 0.25 | 0.0025 |
| Ash | 5.12 | 3.63 | 0.0363 |
| | 100.00 | 29.19 | 0.2919 |
| Moisture | 29.19 | 100.00 | 1.0000 |

Calculation of consumption of oxygen per lb. coal fired:

| Ingredient | Ingredient Consumed by Oxygen/Lb. Coal Fired | Chemical Reaction and Molecular Weights | Lbs. Oxygen Consumed per Lb. Coal Fired |
|---|---|---|---|
| | | multiplier | |
| Carbon | 0.3421 | 12<br>C +<br>32 44<br>$O_2$ $CO_2$<br>32/12 = 2.67 | 0.913 |
| Hydrogen | 0.0462 | 4<br>$2H_2$ +<br>32 36<br>$O_2$ $2H_2O$<br>32/4 8.0 | 0.370 |
| Sulphur | 0.0025 | 32<br>S +<br>32 64<br>$O_2$ $SO_2$<br>32/32 1.0 | 0.003 |

| | | |
|---|---|---|
| Oxygen from ambient air needed to burn coal | Total | 1.286 |
| less oxygen in coal | | .276 |
| oxygen required per reaction est. | | 1.010 |
| add 24% excess air for complete combustion | | 0.242 |
| | Total | 1.252 |
| From above, nitrogen in stack gas from the excess air added = 1.252 × 79/21(N/O) | 4.710 | |
| add Nitrogen in coal | 0.005 | |
| Nitrogen (per lb. coal) in the flue gases | | 4.715 |
| Carbon Dioxide, 0.3421 × 44/12 ($CO_2$/C) | | 1.254 |
| Oxygen from excess air (not combusted) | | 0.242 |
| Water in air needed for combustion and for 24% excess (1.286 + 0.242) × 100/21 and × 0.01657 $H_2O$ at 50% humidity at 77 F. | 0.1276 | |
| water in coal | 0.2919 | |
| water from hydrogen, 0.0462 × 36/40 | 0.4158 | |
| Total $H_2O$ in flue gases: | | 0.835 |
| Sulphur dioxide in flue gases 0.0025 × 64/32 | | 0.005 |
| Total lb. flue fas per lb. coal fired in furnace | | 7.051 |

Sensible heat in flue gases from 600–77 degrees F. cooling:

| Ingredient | Lbs/Lb Coal | Average Specific Heat | Temp Diff. | Recoverable Btu/lb. coal |
|---|---|---|---|---|
| Nitrogen | 4.715 | 0.2513 | 523 | 620 |
| Carbon Dioxide | 1.254 | 0.2320 | 523 | 152 |
| Oxygen | 0.242 | 0.2282 | 523 | 29 |
| Water Vapor | 0.835 | 0.4610 | 523 | 201 |
| Sulphur Dioxide | 0.005 | 0.1664 | 523 | 0 |
| | | | | 1002 |
| Water vapor heat of condensation 970 × 0.835 | | | | 810 |
| Theoretically recoverable heat from flue gases | | | | 1822 |

What saving can be made if fuel is estimated from the well known Dulong's formula for the higher heating value of a coal:

Btu per lb. coal = 14,544 × Carbon + 62,028 × (Hydrogen-Oxygen/8) + 4,050 × Sulphur

| | |
|---|---|
| Carbon 0.4831 × 14,544 | 7026 |
| Hydrogen (0.0653 − 0.3902/8) × 62,028 | 1023 |
| Sulphur 0.0035 × 4,050 | 14 |
| | 8063 |

From the above the dollar savings may be estimated.

let 4000 = tons coal fired as received without this invention let X = tons coal saved by this invention @ 100% efficiency then (4000 − X) ×8063 × 2000 lbs. = Btu produced by this invention per day.

and (8063 − 1822) = 6241 = Btu produced/lb. without

-continued invention
equating (4000 − X) × 8063 × 2000 = (8063 − 1822) × 2000 × 4000
4000 × 6241/8063 = 4000 − X
X = 4000 − 3096 = 904 tons/day @ 100% efficiency
= 723 tons/day at 80% recovery of heat from hot gas
= 723/4000 = 18% saving Estimated savings per day = 723 × $30/ton coal = $21,690
Estimated Savings per year = $7,800,000 for 360 day year

EXAMPLE II

With the same coal as noted in Example I, but applying the invention to recovery of heat in the flue gases cooling them from 400°–77° F., the cooling calculations are as follows:

Sensible heat in flue gases from 400–77° F. cooling:

| Ingredient | Lbs/Lb Coal | Average Specific Heat | Temp Diff. | Recoverable Btu/lb. coal |
|---|---|---|---|---|
| Nitrogen | 4.715 | 0.2499 | 323 | 380 |
| Carbon dioxide | 1.254 | 0.2223 | 323 | 90 |
| Oxygen | 0.242 | 0.2245 | 323 | 18 |
| Water Vapor | 0.835 | 0.4540 | 323 | 122 |
| Sulphur Dioxide | 0.005 | 0.1606 | 323 | 0 |
| | | | | 610 |
| Water vapor heat of condensation 970 × 0.835 | | | | 810 |
| Theoretically recoverable heat from flue gases | | | | 1420 |

From the above the dollar savings of Example II may be estimated in similar manner to that shown in Example I.

let 4000 = tons coal fired as received without this invention
let X = tons coal saved by this invention @ 100% efficiency
then (4000 − X) × 8063 × 2000 lbs. = Btu produced by this invention per day
and (8063 − 1420) = 6643 Btu/lb. coal without this invention
equating (4000 − X) × 8063 × 2000 = 4000 × 6643 × 2000
4000 × 6643/8063 = 4000 − X
X = 4000 − 3296 = 704 tons per day @ 100% efficiency
= 563 tons/day @ 80% efficiency of recovery of heat
Estimated savings per day = 563 × $30 = $16,890
Estimated savings per year = $6,080,000 for 360 day year A critical question to be examined in the design of rock beds for heat regeneration is the flue gas velocity per face foot area, since this affects draft loss and hence power needed for forced and induced draft fans. Below is a Table for determining gas volumes at different temperatures of Examples I and II. It involves determining mols of each gaseous ingredient. Then, since all these gases have the same number of molecules and volume per mol, their total volume at any temperature can be easily determined by the gas laws PV=RT. In the case of water, it condenses in accordance with its partial pressure in the gas mixture. In doing so its volume shrinks about 1000/l thus lowering gas volume by that amount in addition to the shrinkage by the gas laws PV=RT. One mol at 459 Rankine has a volume of 359 cubic feet.

Calculation of Mols of Gas in Examples I and II:

| Gas | Lbs/Lb Coal As Fired | Mol Weight | Mols Gas | Vol. in cu/ft of gas per lb coal 32F 459R | 77 537 | 200 660 | 212 672 | 400 860 | 600 1060 |
|---|---|---|---|---|---|---|---|---|---|
| $N_2$ | 4.715 | 28 | 0.1684 | 60 | 71 | 86 | 88 | 113 | 140 |
| $CO_2$ | 1.254 | 44 | 0.0285 | 10 | 12 | 15 | 15 | 19 | 23 |
| $O_2$ | 0.242 | 32 | 0.0076 | 3 | 3 | 4 | 4 | 5 | 6 |
| $H_2O$ | 0.835 | 18 | 0.0464 | | | | 24 | 31 | 38 |
| $SO_2$ | 0.005 | 64 | | | | | | | |
| Gas volumes per pound coal | | | | 73 | 86 | 105 | 131 | 168 | 207 |
| Add $H_2O$ in 50% humidity air | | | | 3 | 3 | 4 | 5 | 6 | 7 |
| | | | | 76 | 88 | 109 | 136 | 174 | 217 |

An area of rock bed through which the above flue gases are to be drawn is computed below from the annular area of semicircles by assuming that the largest bed diameter is 104 feet.

| Circle Diameter (in feet) | Semicircle Area $\pi r^2/2$ (square feet) | Assuming as follows: |
|---|---|---|
| 100–104 | 320 | tons coal fired per day = 4000 |
| 80–100 | 1413 | lbs. coal fired per second = |
| 60–80 | 1100 | 92.59, then the cubic feet of |
| 40–60 | 786 | gas per second equal the above |
| Total bed area | 3619 | derived volumes at various |
| Less 10% segment | 3257 | temperatures multplied by 92.59. |

| Temperature, degrees F. | 32 | 77 | 200 | 212 | 400 | 600 |
|---|---|---|---|---|---|---|
| Cu. ft. flue gas/lb coal | 73 | 89 | 109 | 136 | 174 | 214 |
| Cu. ft. flue gas/sec. | 8240 | 10092 | 12592 | 16110 | 19814 | |
| Cu. ft. gas/sec./sq. ft (i.e. ÷ 3257) | 2.5 | 3.1 | 3.9 | 4.9 | 6.1 | |

The phenomena involved in this invention relate to those in the metallurgy of iron, and a reference on iron sintering in a bed of solids is found on pages 94–98 of TRANSPORT PHENOMENA IN METALLURGY, by G. H. Geiger and D. R. Poirer, Addison Wesley Publishing Co., Reading, Mass., Menlo Park, Calif. From this excellent reference, I estimate rock beds described above draft losses as shown below:

| | Example I | Example II |
|---|---|---|
| Temperature of flue gas at top of beds F. | 400 | 600 |
| Flue gas velocity at bed face in ft/sec. | 4.9 | 6.1 |
| | Draft loss inches water | |
| Draft loss in 2 ft. of 2 in. dia. rocks with tubes embedded in second foot | 1.58 | 2.44 |
| Draft loss in 8 ins. of 4 in. dia. rocks | 0.12 | 0.12 |
| Draft loss in 8 ins. of 8 in. dia. rocks | 0.06 | 0.06 |
| Draft loss in 20 ft. of 12 in. dia. rocks | 0.88 | 0.88 |
| Total draft loss in the induced draft | 2.64 | 3.50 |
| Total draft loss in the forced draft | 2.64 | 3.50 |

-continued

| | Example I | Example II |
|---|---|---|
| | 5.28 | 7.0 |

The first case would be one in which the power plant was already recovering sensible heat down to 400 F., while the second case would be one in which it was desired to recover heat from 600 F. flue gas. In either case, both sensible heat and heat of condensation would be recovered. It is assumed that the tubes containing feedwater embedded in the second one-foot layer down would absorb heat as fast or faster than the 2 inch diameter rocks whose heat transfer coefficient is estimated below from a nomograph on page 413 of the above mentioned TRANSPORT PHENOMENA IN METALLURGY.

| | Example I | Example II |
|---|---|---|
| Temperature F. | 400 | 600 |
| Face velocity ft/sec | 4.9 | 6.1 |
| Rock dia. ins. | 2 | 2 |
| Rate of heat transfer Btu/cu. ft./min/F°. | 10.5 | 13.4 |
| Temperature range involved | 400–77<br>323 | 600–77<br>523 |
| Heat transfer rate Btu/sq. ft./minute | 11,000 | 23,000 |
| Sensible heat to be recovered per minute is 5556 lb. coal/min × Btu in flue gas | 3,389,160 | 5,567,112 |
| which amounts divided by 3257 face area = | 1042 | 1709 |
| Therefore, min. per half revolution of bed = | 10.5 | 13.5 |
| min. per full revolution | 21 | 27 |

The above assumes that only sensible heat of the flue gases is being recovered. To recover the heat of condensation as well as sensible heat, proportional increase must be made in the speed of rotation as shown below:

| | Example II Case I | Example I Case II |
|---|---|---|
| In Example I, 1002/1822 × 13.5 | | 7.4 |
| In Example II, 610/1420 × 10.5 | 4.5 | |
| Or in minutes for revolution of bed | 9.0 | 14.8 |
| Or in revolutions per hour | 6.5 | 4 |

The size of the beds is not determined by the rate of heat transfer, but by allowable draft loss which may amount to hundreds of thousands of dollars per year, as shown by the following approximation for Examples I and II:

$$\frac{\text{cu. ft. air/min} \times \text{draft loss ins. water}}{\text{horsepower} = 6356}$$

$$\frac{\overset{\text{min}}{60} \times \overset{\text{cfs}}{10{,}000} \times 8}{6356} = 755 \text{ hp at 80\% efficiency}$$

$$= 944 \text{ hp or } 704 \text{ kw}$$

Applying a cost of 5 cents per kwh, the annual cost is $308,500; the daily cost is $845.

This invention keeps this loss at a minimum by making the lowest bed of large boulders, as much as 12 inches in diameter, and the depth of these enough so that radial flow outward is not a large part of the draft loss. Likewise, although the top beds may be made of pieces only one inch in diameter, the increased speed of heat absorption attainable with smaller pieces is obviously not needed on account of the already slow speed of rotation. Perfectly spherical pieces help to maintain the theoretical pore space of 0.48 and lessen draft loss.

The ability of the design of the invention to float the great weight of rock beds is illustrated in the table below:

| | | | Weight of Beds in Tons | Bouyant Effect in Tons |
|---|---|---|---|---|
| | | | area × 10 ft. deep × 147 lbs × 52% solids less 6.24 lbs wt. water | area × 10 ft. deep × 62.4 lbs. water / 534 |
| Annular Area Between Circle Diameters | | | | |
| Empty | Periphery | 114–104 1712<br>100–104 640 | | |
| Rock Filled Areas | Annular | 80–100 2827 | | |
| | | 60–80 2200 | | |
| | | 40–60 1571<br>7238 | 509 | |
| Central Circular Areas | | 40 1256 | | 392 |
| Steel Shapes and Steel Weights | | | | |
| Bottom 10207 × 1/24 × 450/2000 | | | 95.7 | |
| Outer ring 358 × 10 × 1/24 × 450/2000 | | | 33.6 | |
| Inner ring 126 × 10 × 1/24 × 450/2000 | | | 11.8 | |
| Stainless Steel Shapes and Weights | | | | |
| Bottom 10207 × 1/48 × 480/2000 | | | 51 | |
| Outer ring 327 × 10 × 1/48 × 480/2000 | | | 16.3 | |
| Inner ring 126 × 10 × 1/48 × 480/2000 | | | 6.3 | |
| Segments 24 × 64 × 10 1/48 × 480/2000 | | | 76.8 | |
| | | | 291.5 | |
| Weight of beds and steel | | | 800 tons | 926 Buoyance |
| Buoyant effect of vessel floating each inch above pan-shaped rim 10207 − (1712 + 1256) = 7239 sq. ft. 7239 × 1/12 × 62.4 wt. water/2000 = | | | | 18.8 |

Inches brim of vessel will float above water level 926–800/18.8–6.7 inches

Figure 4:
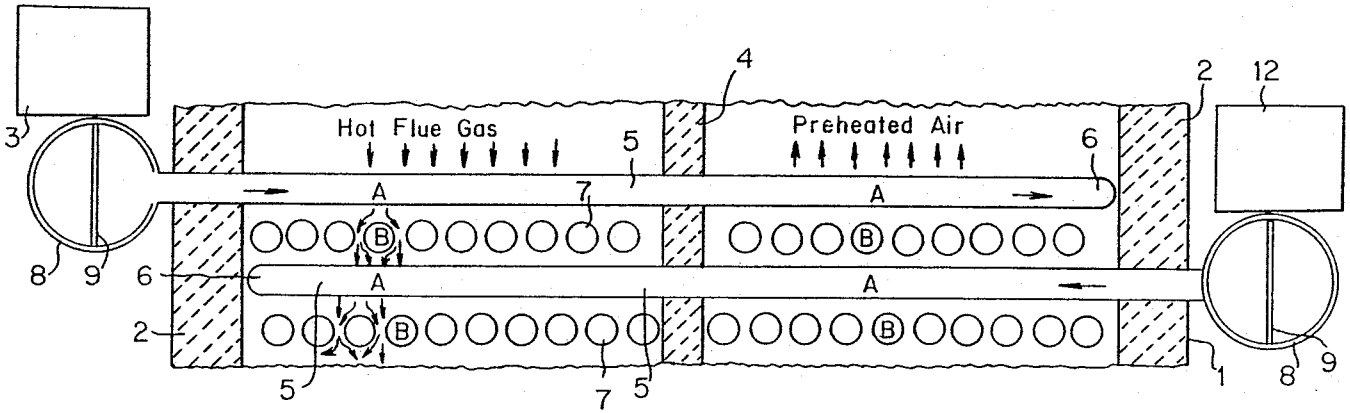
FIG. 4 is a vertical cross-section through an alternate embodiment of the invention.
Figure 5:
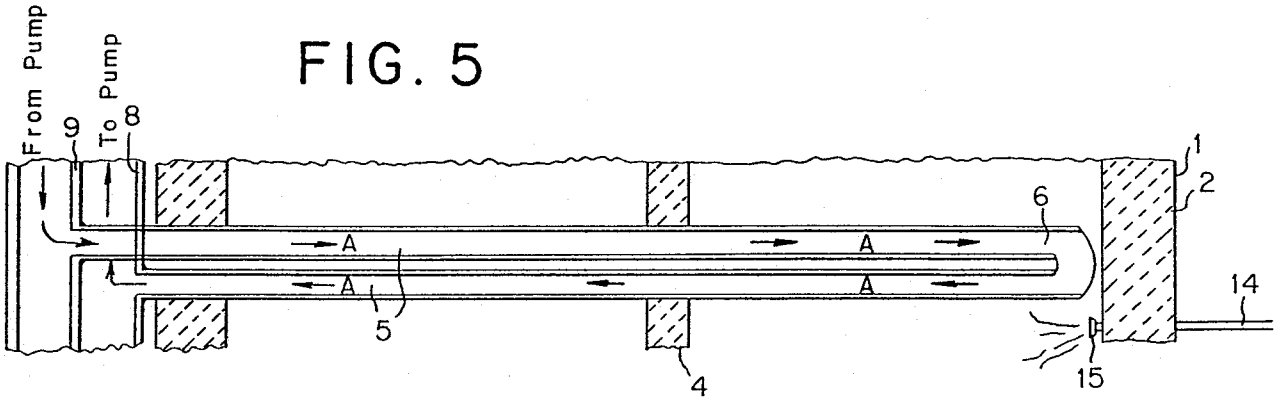
FIG. 5 is a horizontal cross-section through a tube for use in the embodiment of FIG. 4.
Figure 6:
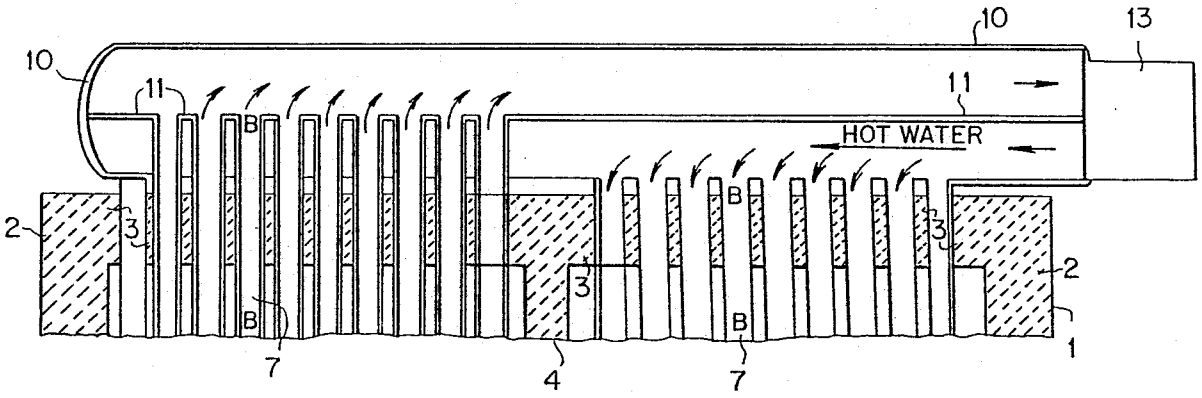
FIG. 6 is a horizontal cross-section through a second tube-type for use in the embodiment of FIG. 4.

FIGS. 4, 5 and 6 illustrate a simplification of this invention not necessarily requiring the use of rotating rockbeds but rather regeneration of the heat in flue gas to preheat air used for the combustion of the flue gas or preheat boiler feedwater. This heat regeneration is accomplished by passing the flue gas downward through about half the length of two or more successive layers of water-filled, acid-resistant tubes while passing air needed for combustion upwardly through the other half length of tubes. All the tubes are arranged horizontally within a heat insulated and acid-proof enclosure having a vertical partition separating the lengths of cooling tubes the flue gas from the lengths of tubes preheating air. The water in each tube is rapidly circulated within the tubes of that layer of tubes. The tubes in any successive layer are arranged at right angles to create turbulent flow of flue gas downwardly as well as incoming air upwardly and thus obtain much higher rates of heat exchange than possible with gases traveling like a sheet around the curved surfaces of the tubes. In effect, heat exchange rates similar to those attainable in rockbeds are obtainable.

The invention features may be better understood by reference to FIG. 4, which is a vertical cross-section through an enclosure housing the layer of tubes. FIG. 5 which is a horizontal cross-section through one type of tube "A" shown in FIG. 4 and then by examination of FIG. 6 which is a horizontal cross-section through all the "B" type tubes of FIG. 4 which lie in the next successive layer below or above the "A" tube layers and run at right angles thereto. In the regenerator 1, 2 are the heat insulated and acid resistant vertical side walls and 4 the vertical divider wall between the hot flue gases and the incoming air for combustion being preheated. All these walls are lined on the interior with stainless steel or preferably titanium sheet while compacted large and fine particles of boiler plant slag is suitable for the bulk of the walls to provide heat insulative and acid-proof qualities. In most cases, the walls will need to be from a few feet up to fifteen feet high to enclose all the heat exchange pipe or tube layers to recover heat from 800 F. to 70 F. At the temperature range from about 250 F. down to 107 F. where the heat of condensation is being recovered, boiler feedwater at a temperature near 107 F. is required as the circulation fluid in all the successive layers of tubes since the heat of condensation is often as large or larger than the sensible heat of the boiler flue gases from 800 F. to 70 F. and the total volume of boiler feedwater will always be many times larger than that required to condense the moisture in the glue gases.

The "A" type tubes 5 have a return-bend 6 to return water to the side header 8 with its divider 9, while the "B" type tubes 7 return water to the end header 10 with its divider 11. Side circulating pumps 12, and end circulating pump 13 route the water through the hot flue gas side to the side where the air is preheated. The nuisance of flyash mixed with the sulphurous and sulphuric acid condensate droplets collecting on the tube surface is obviated by jets 15 fed by pipes 14 with cooled condensate which has been cleaned of particulate matter and its dissolved $SO_2$ so it may be used as a tube washing fluid instead of fresh water. Sizes of tubes and circulation therethrough suit conditions.

Figure 3:
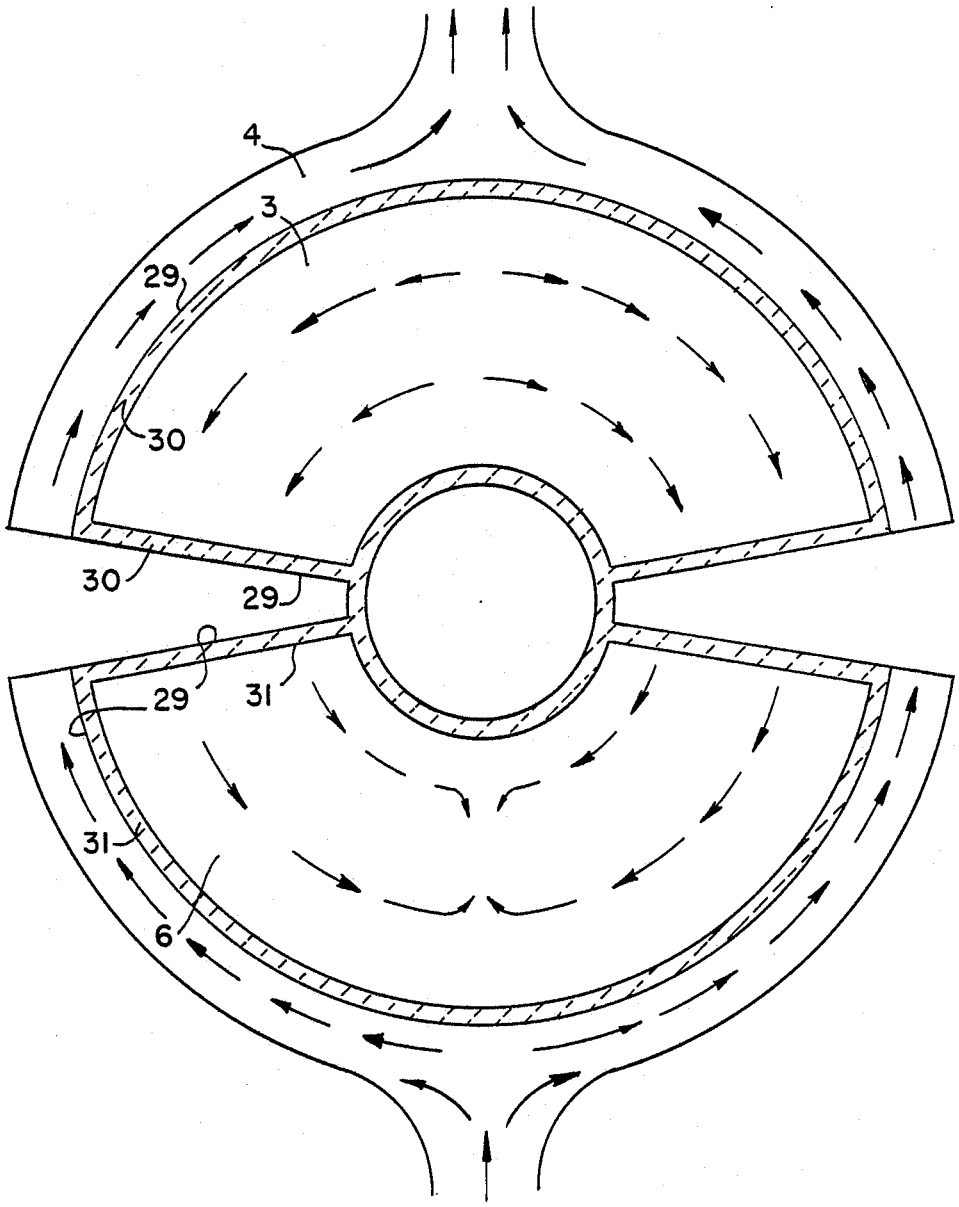
FIG. 3 is a horizontal cross-section through the base of the mantles of the heat regenerator of the present invention.

While the simple regenerator design of FIGS. 4, 5, and 6 may be very suitable for power plants fired with oil, natural gas or coal low in ash; the rotating rockbeds of FIGS. 1, 2 and 3 may be the only satisfactory heat recovery method for power plants fired with coal high in sulphur or ash content.

While the circulation of water as a heat transfer medium has been suggested in the regenerator tubes of this invention, refrigerants may be chosen which evaporate and condense in the temperature ranges shown or will produce electric power or just mechanical horsepower before condensing. This avoids the expense of operating the circulation pumps and produces energy apart from the main power plant.

We claim:

1. A heat regenerator for removing waste heat from the exhaust gasses of a fossil fuel furnace boiler and regenerating said heat to preheat combustion air for the furnace and feedwater for the boiler comprising:

(a) a bed of aggregate wherein the aggregate is sized pieces with larger pieces toward bottom of said bed;

(b) a circular vessel for containing said vessel having an acid resistant lining;

(c) a floatation pool of water for rotatably floating said vessel;

(d) rotation means for rotating said vessel about a fixed vertical axis as said vessel floats on said pool;

(e) radially and vertically extending separators positioned in said bed to separate said bed into wedge shaped portions;

(f) a first semi-circular mantle positioned over half of said bed for supplying hot gasses from said furnace to the top of said bed to be drawn therethrough by fans which exhaust the cooled gasses to the atmosphere;

(g) a second mantle positioned over the remainder of said bed for drawing ambient air up through the portions of said bed therebelow so rotation of said bed causes each wedge shaped portion to move beneath said first mantle to be heated by the exhaust gasses passing therethrough and then beneath said second mantle to preheat the combustion air passing therethrough.

2. The heat regenerator according to claim 1 wherein:

(a) acid resistant pipes are positioned within said bed and boiler feedwater is circulated through said pipes to absorb the heat of condensation of water vapor in said exhaust gasses and thereby preheat the boiler feedwater.

* * * * *

UNITED STATES PATENT AND TRADEMARK OFFICE

CERTIFICATE OF CORRECTION

PATENT NO. : 4,813,473

DATED : March 21, 1989

INVENTOR(S) : Arthur F. Johnson

It is certified that error appears in the above-identified patent and that said Letters Patent is hereby corrected as shown below:

In claim 1, line 8: change "said vessel" to -- said bed --.

Signed and Sealed this

Eighteenth Day of December, 1990

*Attest:*

HARRY F. MANBECK, JR.

*Attesting Officer*

*Commissioner of Patents and Trademarks*